US010609978B2

(12) United States Patent
Cho

(10) Patent No.: US 10,609,978 B2
(45) Date of Patent: Apr. 7, 2020

(54) GOLF CAP HAVING BALL MARKER

(71) Applicant: YUPOONG, INC., Seoul (KR)

(72) Inventor: Byoung-Woo Cho, Seoul (KR)

(73) Assignee: YUPOONG, INC., Seoul (KR)

( * ) Notice: Subject to any disclaimer, the term of this patent is extended or adjusted under 35 U.S.C. 154(b) by 0 days.

(21) Appl. No.: 14/454,333

(22) Filed: Aug. 7, 2014

(65) Prior Publication Data

US 2015/0040291 A1 Feb. 12, 2015

Related U.S. Application Data

(60) Provisional application No. 61/864,284, filed on Aug. 9, 2013.

(30) Foreign Application Priority Data

Aug. 9, 2013 (KR) ..... 10-2013-0094986
Aug. 6, 2014 (KR) ..... 10-2014-0101109

(51) Int. Cl.
*A42B 1/24* (2006.01)
*A63B 57/20* (2015.01)
*A63B 57/30* (2015.01)

(52) U.S. Cl.
CPC ..... *A42B 1/24* (2013.01); *A63B 57/207* (2015.10); *A63B 57/353* (2015.10); *A63B 2209/08* (2013.01); *A63B 2209/10* (2013.01)

(58) Field of Classification Search
CPC ..... A42B 1/24; A42B 1/067; A42B 1/062; A42B 1/248; A63B 57/207; A63B 57/353; A63B 2209/10; A63B 2209/08
USPC ..... 2/171, 195.1, 175.1, 209.12, 209.13; 224/918; 40/1.5, 329, 630
See application file for complete search history.

(56) References Cited

U.S. PATENT DOCUMENTS 3,009,235 A * 11/1961 De Mestral ..... A44B 18/0023 128/DIG. 15
3,130,111 A * 4/1964 Izumi ..... A44B 18/0038 128/DIG. 15
3,895,797 A * 7/1975 Moore ..... A42B 1/24 128/DIG. 15

(Continued)

FOREIGN PATENT DOCUMENTS

EP 1099458 A2 5/2001
JP 3107164 11/2004

(Continued)

*Primary Examiner* — Nathan E Durham
*Assistant Examiner* — Abby M Spatz
(74) *Attorney, Agent, or Firm* — Lex IP Meister, PLLC

(57) ABSTRACT

A golf cap having a ball marker proposed in the present invention includes: a ball marker which has a first coupling portion having one surface formed with a plurality of male members, e.g., hooks, or female members, e.g., loops, and a second coupling portion which corresponds to the first coupling portion, and has a plurality of female members when one surface of the first coupling portion has a plurality of male members, or has a plurality of male members when the one surface of the first coupling portion has a plurality of female members, so that the ball marker is attached to and detached from the second coupling portion, thereby improving convenience when carrying and using the ball marker, and improving detachable function between the ball marker and the cap in use.

3 Claims, 13 Drawing Sheets

(56) References Cited

U.S. PATENT DOCUMENTS

| | | | | | |
|---|---|---|---|---|---|
| 3,938,805 | A * | 2/1976 | Sakuma | A63B 57/207 | 473/406 |
| 4,604,819 | A * | 8/1986 | Grey | A44C 3/004 | 40/1.5 |
| 4,611,355 | A * | 9/1986 | Galanto | A42B 1/248 | 2/209.13 |
| 4,873,726 | A * | 10/1989 | Tapia | A42B 1/064 | 2/10 |
| 5,373,586 | A * | 12/1994 | Brosnan | A42B 1/248 | 2/195.1 |
| 5,933,867 | A * | 8/1999 | Corder | A41D 19/0051 | 2/160 |
| 6,052,828 | A * | 4/2000 | Widdemer | A41F 1/06 | 2/159 |
| 6,422,955 | B1 * | 7/2002 | Lopez | A42B 1/24 | 224/918 |
| 2002/0162260 | A1 * | 11/2002 | Tate | G09F 23/00 | 40/630 |
| 2006/0005361 | A1 * | 1/2006 | O'Banion | A42B 1/24 | 24/303 |
| 2006/0048274 | A1 * | 3/2006 | Lee | A42B 1/062 | 2/181 |

FOREIGN PATENT DOCUMENTS

| | | | |
|---|---|---|---|
| KR | 20-1995-0026343 | U | 10/1995 |
| KR | 20-200257502 | Y1 | 12/2001 |

* cited by examiner

GOLF CAP HAVING BALL MARKER

CROSS REFERENCE TO RELATED APPLICATIONS

This application claims priority to and the benefit of U.S. Patent Application No. 61/864,284 filed in the USPTO on Aug. 9, 2013, and priority to and the benefit of Korean Patent Application No. 10-2013-0094986, filed with the Korean Intellectual Property Office on Aug. 9, 2013, and priority to and the benefit of Korean Patent Application No. 10-2014-0101109, filed with the Korean Intellectual Property Office on Aug. 6, 2014, the entire contents of each of which are incorporated herein by reference.

FIELD OF THE INVENTION

The present invention relates to a golf cap having a ball marker, and more particularly, to a golf cap having a ball marker capable of improving convenience when carrying and using the ball marker, improving detachable function between the ball marker and the cap in use, and improving productivity.

BACKGROUND OF THE INVENTION

Description of the Related Art

In general, when playing a golf game, a player picks up a golf ball on the green in order not to hinder other players from playing his/her turn, and after everyone has played his/her turn, the player places the ball again at the position where the ball was, and continues to play the game.

Most players carry and use a coin-shaped ball marker in order to clearly mark the position at which his/her ball was positioned.

However, the ball marker, being small in size and thickness is mixed up with other items such as a tee and a golf ball, for example, when the player carries the ball marker in his/her pocket. As a result, it is not easy for the player to draw the ball marker from the pocket. Further, when the player wears a glove on his/her hand, it is difficult to put the hand into the pocket and take the hand out of the pocket, such that it is inconvenient to use the ball marker, and there is a risk that the ball marker is damaged and lost.

In order to solve the aforementioned problem, there has been proposed a method of attaching a permanent magnet to a clip-type fixing member which may be fastened to an edge of clothes or an edge of a visor portion of a cap, and applying a ball marker made of materials that the magnetic force of the fixing member attracts.

However, the method has drawbacks. The clip-type fixing member needs to be separately manufactured, and holding power of the clip depends on thickness of clothes or the visor portion of the cap. When the pressure to the elastic body mounts, the clip-type fixing member is easily detached from the position of the clothes or the visor portion of the cap to which the fixing member was originally fastened, and as a result, the ball marker is lost.

Meanwhile, there has been proposed a method of having a ball marker fixing member fitted in a hole formed on the visor portion of the cap.

However, the aforementioned method has drawbacks in that the cap is artificially and inevitably damaged because the hole needs to be formed on the visor portion or the like of the cap, and an aesthetic appearance of the cap deteriorates even if the damage is repaired.

In addition, it may inconvenience the wearer of the cap because a weight of the cap is concentrated on the visor portion, and the cap may be easily pulled off the head because the center of gravity is at a front side of the wearer.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a golf cap having a ball marker capable of improving convenience when carrying and using the ball marker, improving detachable functionality between the ball marker and the cap in use, and improving productivity.

In addition, the present invention has been made in an effort to provide a golf cap having a ball marker capable of improving productivity by improving performance of a technical configuration and simplifying a manufacturing process.

An exemplary embodiment of the present invention provides a golf cap having a ball marker, including: a ball marker which has a first coupling portion having one surface formed with a plurality of male members, e.g., hooks, or female members, e.g., loops, and a second coupling portion which corresponds to the first coupling portion, and has a plurality of female members when one surface of the first coupling portion has a plurality of male members, or has a plurality of male members when the one surface of the first coupling portion has a plurality of female members, so that the ball marker is attached to and detached from the second coupling portion.

According to the golf cap having the ball marker according to the exemplary embodiment of the present invention, the ball marker may be easily carried on the cap because the ball marker has a small size and a small thickness, and it is possible to reduce a risk of loss because the ball marker may be separated from the cap to be used, and coupled to the cap again to be carried.

In addition, according to the golf cap having the ball marker according to the exemplary embodiment of the present invention, there is no need to manufacture a fixing member for a ball marker with additional costs and efforts. Also, there is no concern about a risk of losing the ball marker due to deterioration of the ball marker.

Moreover, according to the golf cap having the ball marker according to the exemplary embodiment of the present invention, it is not necessary to form a fixing member for a ball marker on a cap while damaging the cap itself or affecting an overall aesthetic appearance of the cap, and there is a technical effect of improving convenience due to the fixing member for a ball marker when wearing the cap.

DETAILED DESCRIPTION OF THE PREFERRED EMBODIMENTS

Figure 1:
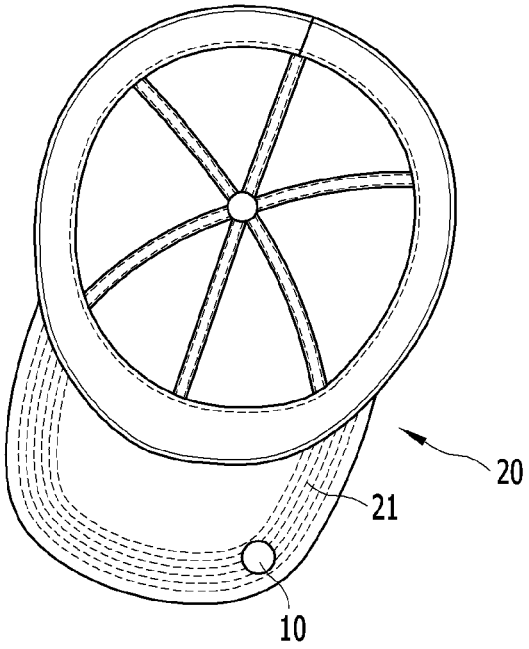
FIG. 1 is a view schematically illustrating a golf cap having a ball marker according to an exemplary embodiment of the present invention.

Hereinafter, a technical configuration of a golf cap having a ball marker according to an exemplary embodiment of the present invention will be described in detail with reference to the accompanying drawings.

First, as illustrated in FIGS. 1 to 13, a golf cap 20 having a ball marker according to an exemplary embodiment of the present invention may include a ball marker 10 which has a first coupling portion 11 having one surface formed with a plurality of male members, e.g., hooks, or female members, e.g., loops, and a second coupling portion 21 which corresponds to the first coupling portion 11, and has a plurality of female members in a case in which the first coupling portion 11 has a plurality of male members, or has a plurality of male members in a case in which the first coupling portion 11 has a plurality of female members, so that the ball marker 10 may be attached to and detached from the second coupling portion 21.

The first coupling portion 11, which has one surface formed with a plurality of male members or female members as described above, is formed on a main body 12 of the ball marker 10, and may include a decorative surface 12*a* that is formed on the other surface so as to display various types of logos or symbols.

As the first coupling portion 11 of the ball marker 10 and the second coupling portion 21 of the cap 20, a female member material or a male member material may be used, but one of the female member or the male member may be made of a plastic material having a predetermined degree or more of elasticity so that coupling strength does not deteriorates despite the repeated attachment and detachment.

Figure 2:
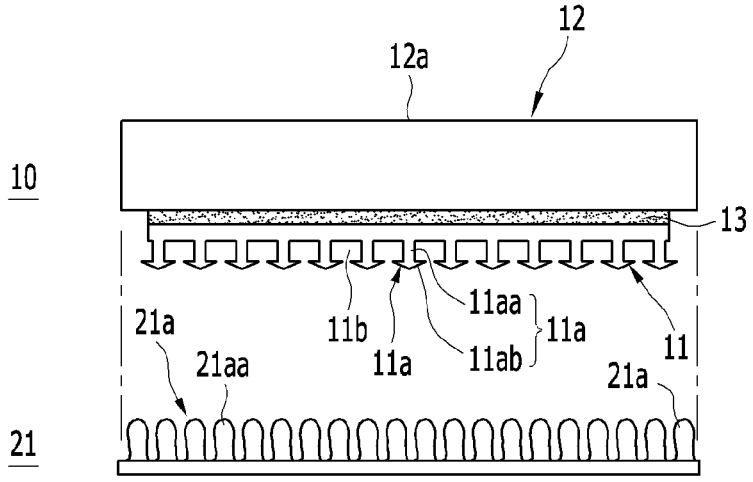
FIG. 2 is a view schematically illustrating a technical configuration of the ball marker used on the golf cap having the ball marker according to the exemplary embodiment of the present invention.

In order to have a predetermined degree or more of elasticity, as illustrated in FIG. 2, a male member 11*a* or a female member 21*a* formed on the first coupling portion 11 and the second coupling portion 21 may have a predetermined shape, and may be disposed regularly.

In addition, by the aforementioned configuration, it is possible to prevent dust or sand from being caught in the first coupling portion 11 or the second coupling portion 12 and contaminating the first coupling portion 11 or the second coupling portion 12, and dust or sand may be easily cleaned out and removed even in a case in which the dust or sand is attached to the first coupling portion 11 or the second coupling portion 12.

For example, the male members 11*a* are regularly formed to have columns 11*aa* which protrude at predetermined intervals 11*b*, and heads 11*ab* which are attached to free ends of the columns 11*aa*. The female members 21*a* of the second coupling portion 21 are formed to have loops 21*aa* so that the heads 11*ab* of the male members 11*a* may be fastened to the loops 21*aa* of the female members 21*a*.

The male member 11*a* may have a hook shape, and the female member 21*a* may have a loop shape.

The main body 12 of the ball marker 10 may be made of at least one of metal, wood, stone, synthetic resin, and fibrous materials. A weight of the main body 12 may be more than about 5 g, and a thickness of the main body 12 may be about 5 mm so that the ball marker 10 may not be blown away by wind while not hindering the golf game when the ball marker 10 is placed on the ground. A thickness of the first coupling portion 11 may not be 30% or more of a thickness of the main body 12.

The first coupling portion 11 may be configured by a sheet made of a synthetic resin material with which the female members or the male members are injection molded, or by a synthetic resin material, which is woven as a plurality of female members or male members, e.g., hooks.

As illustrated in FIG. 2, the first coupling portion 11 may be attached to one surface of the main body 12 of the ball marker 10 by applying an adhesive having an excellent adhesive property onto the one surface or forming an adhesion portion 13 that is formed in the form of a double-sided adhesive sheet.

Meanwhile, in a case in which the first coupling portion 11 is coupled to the one surface of the main body 12 of the ball marker 10 using the adhesion portion 13, the first coupling portion 11 may be abraded and moved away when time has passed or after the first coupling portion 11 is frequently touched by hand.

Figure 3A:
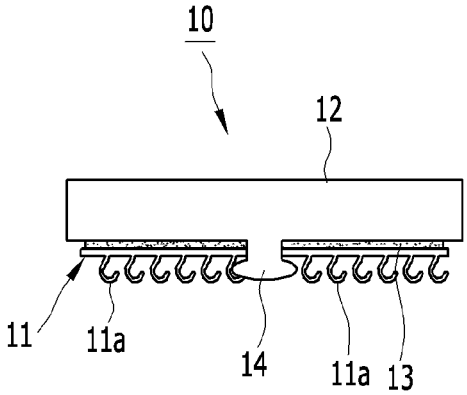
FIG. 3A is a cross sectional view illustrating a first exemplary embodiment of the ball marker of the golf cap having the ball marker according to the exemplary embodiment of the present invention.
Figure 3B:
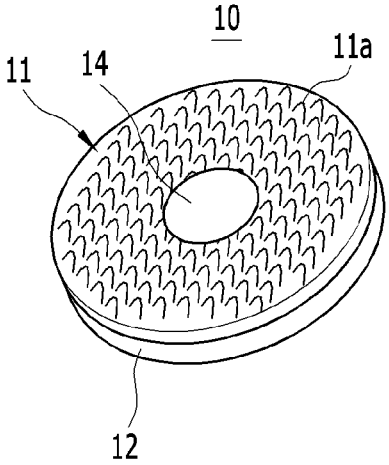
FIG. 3B is a bottom view of the exemplary embodiment shown in FIG. 3A.

Accordingly, as illustrated in FIG. 3, the first coupling portion 11 may be securely attached to the one surface of the main body 12 of the ball marker 10 by an auxiliary coupling means 14 in addition to the adhesion portion 13.

The auxiliary coupling means 14 may be a rivet portion that is disposed at a center of the ball marker 10, and a height of the auxiliary coupling means 14 may be smaller than that of the female member or male member 11*a* of the first coupling portion 11 so as not to hinder the engagement with the second coupling portion 21 of the cap 20.

Figure 4A:
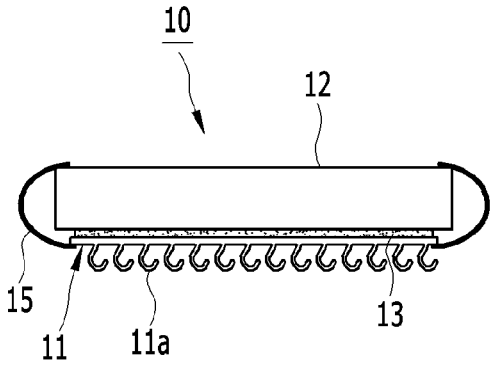
FIG. 4A is a cross sectional view illustrating a second exemplary embodiment of the ball marker of the golf cap having the ball marker according to the exemplary embodiment of the present invention.
Figure 4B:
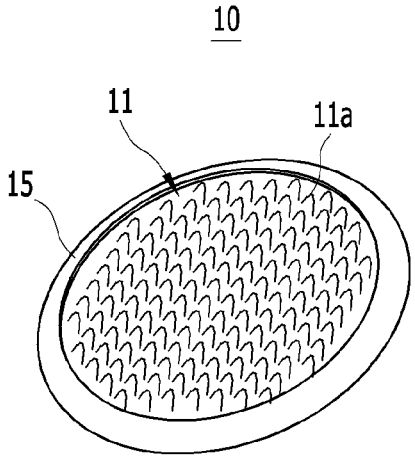
FIG. 4B is a bottom view of the exemplary embodiment shown in FIG. 4A.

As illustrated in FIG. 4, the first coupling portion 11 is coupled to the one surface of the main body 12 of the ball marker 10 using the adhesion portion 13, and a rim portion 15 may be further formed to securely fix external circumferential portions of the main body 12 and the first coupling portion 11 in order to prevent the first coupling portion 11 from being separated from an external circumferential portion of the ball marker 10 which is mainly used when the ball marker 10 is grasped by hand or thrown to the ground.

The rim portion 15 may be simply formed by performing a clasping process of metal.

In a case in which the first coupling portion 11 is integrated with the one surface of the main body 12 of the ball marker 10 by the clasping method, a plurality of clip types may be used for the clasping between the main body 12 and the first coupling portion 11.

Figure 5A:
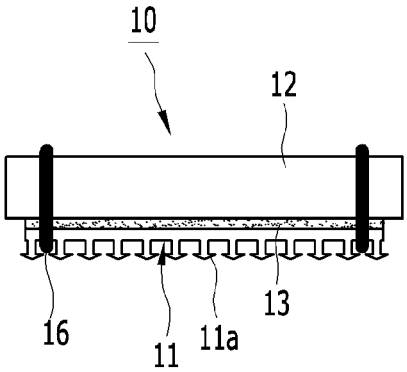
FIG. 5A is a cross sectional view illustrating a third exemplary embodiment of the ball marker of the golf cap having the ball marker according to the exemplary embodiment of the present invention.
Figure 5B:
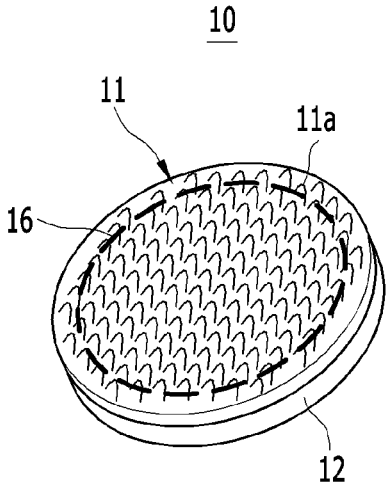
FIG. 5B is a bottom view of the exemplary embodiment shown in FIG. 5A.

As illustrated in FIG. 5, the first coupling portion 11 is coupled to the one surface of the main body 12 of the ball marker 10 using the adhesion portion 13, and a sewing portion 16 may be formed to sew and couple the main body 12 and the first coupling portion 11 in order to prevent the first coupling portion 11 from being separated from an external circumferential portion of the ball marker 10 which is mainly used when the ball marker 10 is grasped by hand or thrown to the ground.

Figure 6:
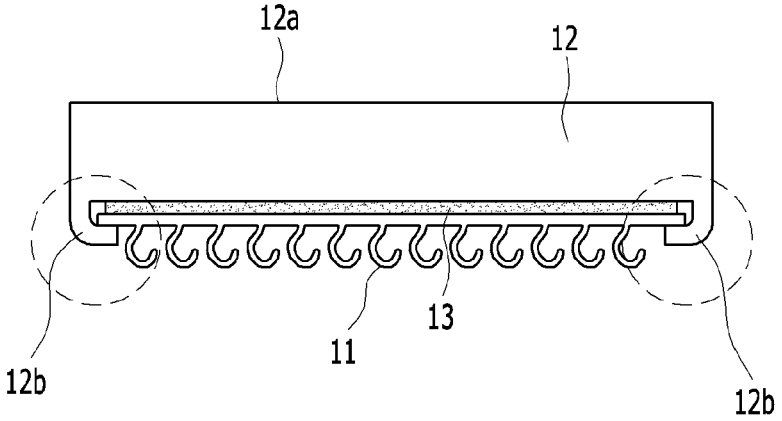
FIG. 6 is a view illustrating a fourth exemplary embodiment of the ball marker of the golf cap having the ball marker according to the exemplary embodiment of the present invention.

As illustrated in FIG. 6, the first coupling portion 11 is coupled to the one surface of the main body 12 of the ball marker 10 using the adhesion portion 13, and a wing end 12*b* is further provided at an edge end along the one surface of the main body 12 in order to prevent the first coupling portion 11 from being easily separated when the ball marker is mainly used to be grasped by hand or thrown to the ground, and the wing end 12*b* may be bent to surround and fix the external circumferential portion of the first coupling portion 11.

Figure 7A:
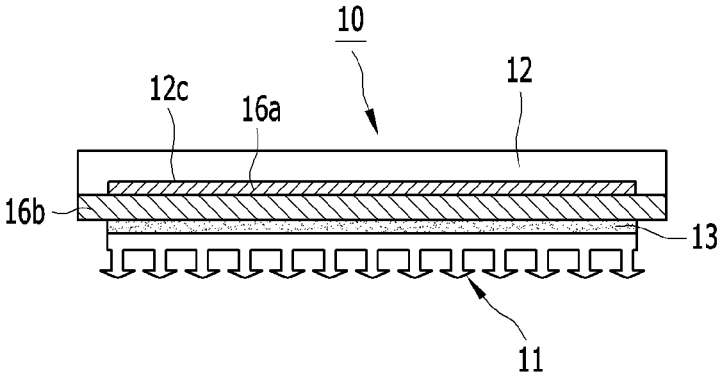
FIG. 7A is a view illustrating a fifth exemplary embodiment of the ball marker of the golf cap having the ball marker according to the exemplary embodiment of the present invention.
Figure 7B:
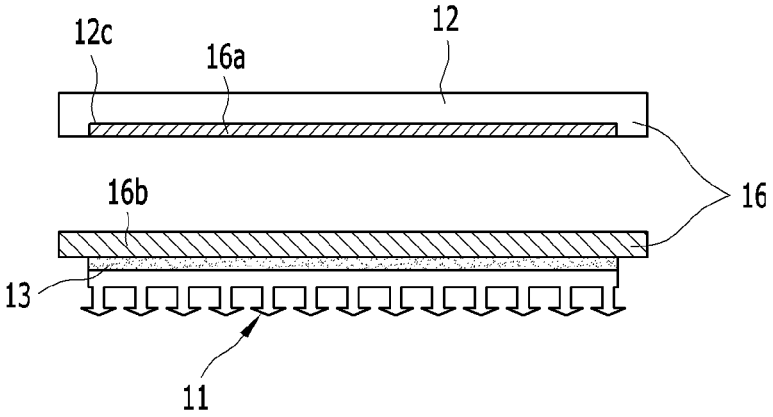
FIG. 7B is an exploded view of the fifth exemplary embodiment shown in FIG. 7.

As illustrated in FIG. 7, the ball marker 10 includes a magnetic attaching and detaching means 16 so that the first coupling portion 11 may be attached to and detached from the one surface of the main body 12, and as a result, the first coupling portion 11 may be replaced when the first coupling portion 11 is abraded or degraded.

As illustrated in FIG. 7, the magnetic attaching and detaching means 16 may include a magnetic synthetic resin portion 16*a* which is fitted into a recess 12*c* formed in the one surface of the main body 12, and a magnetic synthetic resin portion 16*b* which is attached to one surface of the first coupling portion 11.

Like a magnetic, the magnetic synthetic resin portions 16*a* and 16*b* have magnetism that does not give electromagnetic damage to electronics even though a user carries the magnetic synthetic resin portions, and may be coupled to each other. Since the magnetic synthetic resin portions 16*a* and 16*b* have plasticity, the magnetic synthetic resin portions 16*a* and 16*b* may provide various shapes, and may be formed in a shape corresponding to the recess 12*c* formed in the main body 12 so as to provide a flat surface.

Figure 8A:
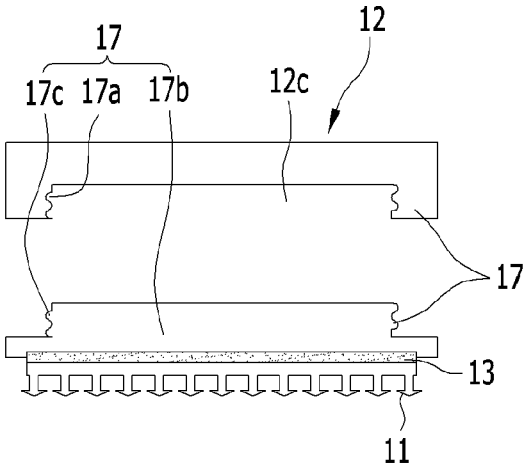
FIG. 8A is an elevational view illustrating a sixth exemplary embodiment of the ball marker of the golf cap having the ball marker according to the exemplary embodiment of the present invention.
Figure 8B:
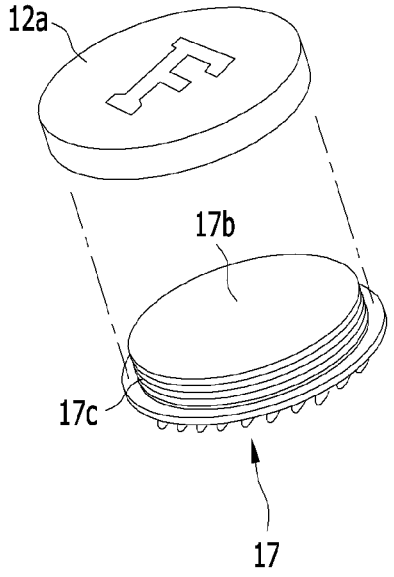
FIG. 8B is a perspective view of the sixth embodiment shown in FIG. 8A.

As illustrated in FIG. 8, the ball marker 10 may include a bolt type attaching and detaching means 17 which enables the first coupling portion 11 to be attached to and detached from the one surface of the main body 12.

The bolt type attaching and detaching means 17 may include a first spiral portion 17*a* which is formed in a circumferential direction of the recess 12*c* formed in the one surface of the main body 12, a solid body 17*b* which is coupled to one surface of the first coupling portion 11 using the adhesion portion 13 and has a shape corresponding to the recess 12*c*, and a second spiral portion 17*c* which is formed in a circumferential direction of the solid body 17*b* and may be coupled to the first spiral portion 17*a*.

The body 17*b* and the second spiral portion 17*c* form a rigid bolt portion, and may be fastened, attached and detached to/from the first spiral portion 17*a* in the recess 12*c* of the main body 12 by being turned with respect to the first spiral portion 17*a*.

Therefore, the first coupling portion 11 may be attached to and detached from the main body 12 while maintaining the thickness and the weight of the ball marker 10 as described above, and the main body 12 that represents logos or marks can be used interchangeably according to the user's taste.

Figure 9A:
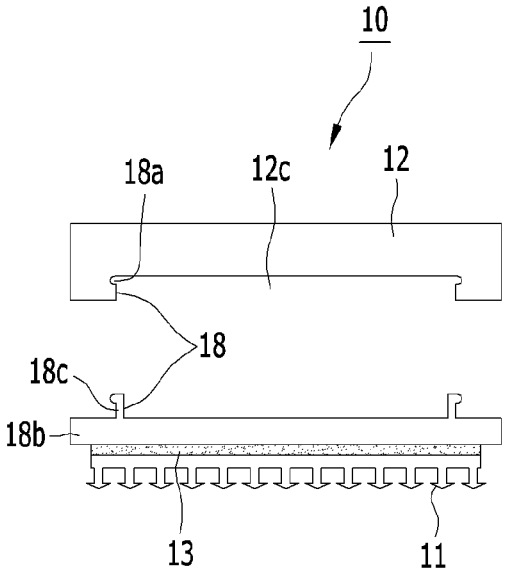
FIG. 9A is an elevational view illustrating a seventh exemplary embodiment of the ball marker of the golf cap having the ball marker according to the exemplary embodiment of the present invention.
Figure 9B:
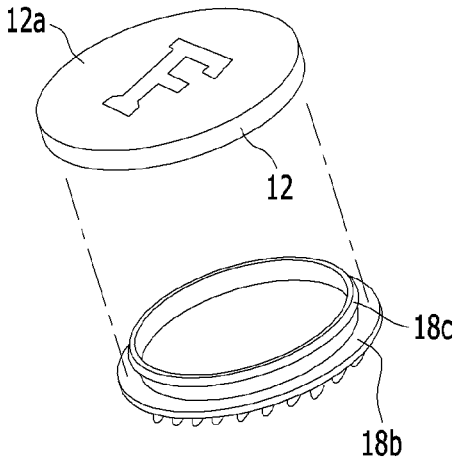
FIG. 9B is a perspective view of the seventh embodiment shown in FIG. 9A.

As illustrated in FIG. 9, the ball marker 10 may include a fastener type attaching and detaching means 18 so that the first coupling portion 11 may be attached to and detached from the one surface of the main body 12.

The fastener type attaching and detaching means 18 may include a female fastener 18*a* which is concavely formed along an edge of the recess 12*c* formed in the one surface of the main body 12, and a male fastener 18*c* which is formed to protrude in the depth direction of recess 12*c* to be correspondingly coupled to the female fastener 18*a* on one side of the cover 18*b*, which covers the recess 12*c* of the main body 12.

The cover 18*b* has one surface corresponding to one surface of the main body 12 to prevent the recess 12*c* from being exposed to the outside and the other surface coupled with the first coupling portion 11 using the adhesion portion 13.

Therefore, as illustrated in FIG. 9, the main body 12 representing logos or marks can be used interchangeably to the user's taste, and the ball maker 10 can be easily coupled with the second coupling portion 21 using the first coupling portion 11.

Figure 10:
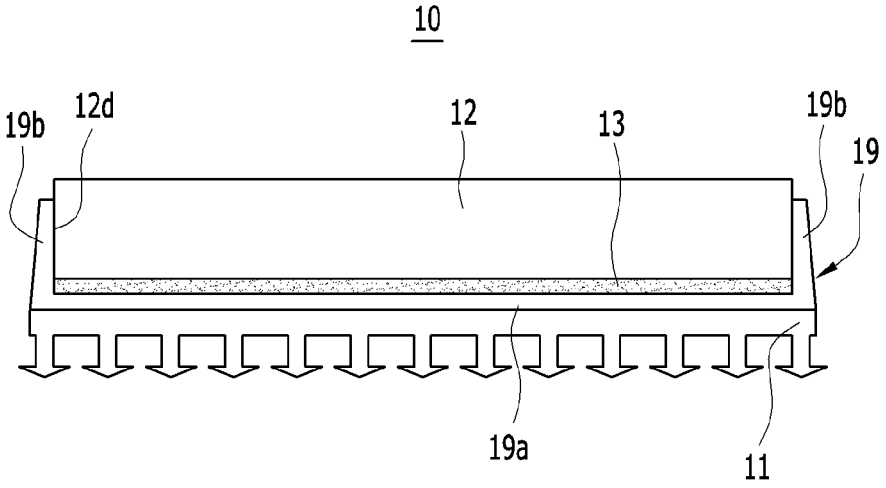
FIG. 10 is a view illustrating an eighth exemplary embodiment of the ball marker of the golf cap having the ball marker according to the exemplary embodiment of the present invention.
Figure 11A:
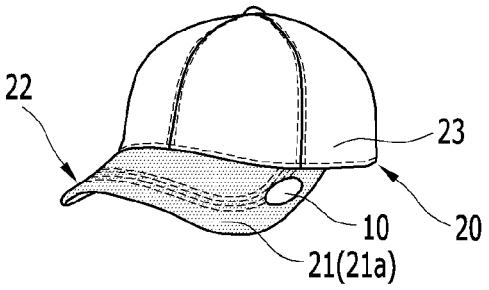
FIG. 11A is a view illustrating a first exemplary embodiment of a second coupling portion of the golf cap having the ball marker according to the exemplary embodiment of the present invention.
Figure 11B:
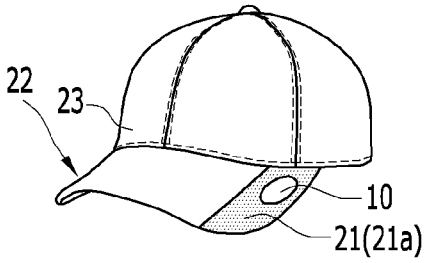
FIG. 11B is a view illustrating a second exemplary embodiment of a second coupling portion of the golf cap having the ball marker according to the exemplary embodiment of the present invention.
Figure 11C:
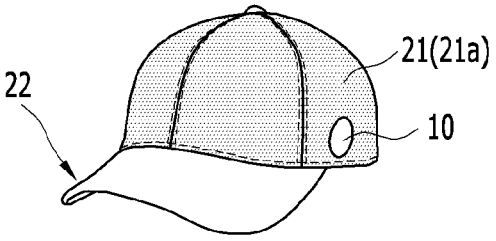
FIG. 11C is a view illustrating a third exemplary embodiment of a second coupling portion of the golf cap having the ball marker according to the exemplary embodiment of the present invention.
Figure 11D:
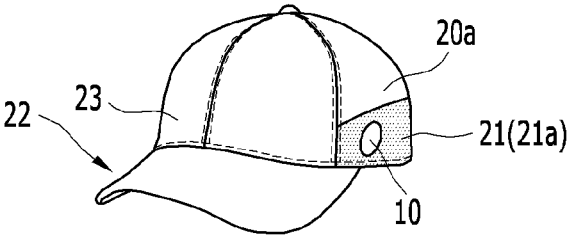
FIG. 11D is a view illustrating a fourth exemplary embodiment of a second coupling portion of the golf cap having the ball marker according to the exemplary embodiment of the present invention.

As illustrated in FIG. 10, in the ball marker 10, the first coupling portion 11 is coupled to the one surface of the main body 12 using the adhesion portion 13, and the first coupling portion 11 may be securely coupled using an auxiliary coupling portion 19 that is manufactured by casting method using a synthetic resin material having elasticity such as natural rubber, polyurethane, or PVC so as to surround a rim portion 12*d* of the main body 12.

The auxiliary coupling portion 19 may include a bottom portion 19*a* which abuts on one surface of the main body 12 and a wall portion 19*b* which is taperingly formed to be thicker around the bottom portion 19*a* and to surround an edge of the main body 12. The auxiliary coupling portion 19 may be tightly and elastically coupled with an edge portion 12*c* of the main body 12.

The first coupling portion 11 is inserted into a casting mold in a desired shape and casted when the auxiliary coupling portion 19 is manufactured by casting method, and as a result, the first coupling portion 11 may be formed in one body without performing a separate adhesion process.

As illustrated in FIG. 11, the second coupling portion 21 of the cap 20 may be applied to at least one of an upper surface or a lower surface of a visor portion 22 and a crown portion 23 that covers the head. In this case, the second coupling portion 21 may be applied to the entire portion or a part of a corresponding portion of the upper surface or the lower surface of the visor portion 22 or the crown portion 23.

Figure 12A:
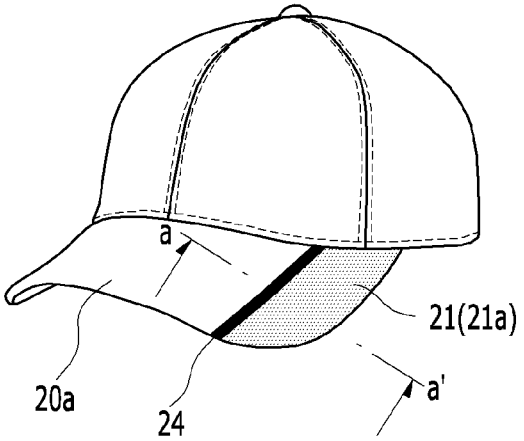
FIG. 12A is a full view illustrating an example of needlework for the second coupling portion of the golf cap having the ball marker according to the exemplary embodiment of the present invention.
Figure 12B:
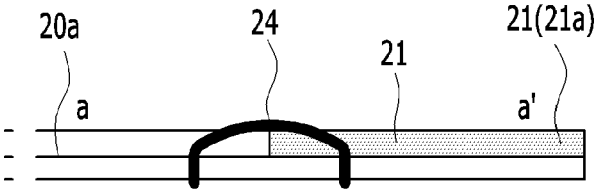
FIG. 12B is a cross sectional view of the example shown in FIG. 12A.

As illustrated in FIG. 12, regarding the second coupling portion 21, a part of an outer fabric 20*a* of the cap 20 is removed, a female member fabric panel or male member fabric panel 21*a* having the female member or male member having the same height is disposed, and the outer fabric 20*a* and the female member fabric panel or male member fabric panel 21*a* are connected using a needlework portion 24 so that a connection portion between the outer fabric 20*a* and the female member fabric panel or male member fabric panel 21*a* may not be exposed.

Figure 13A:
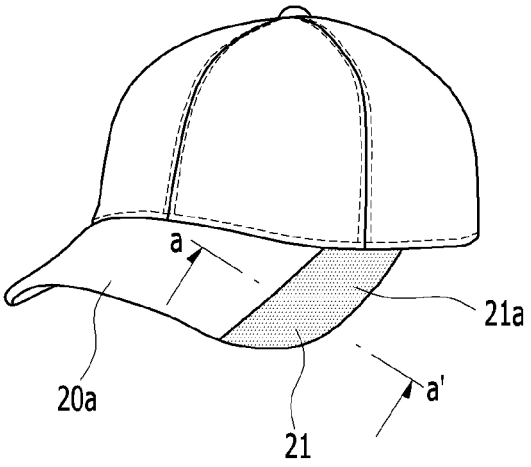
FIG. 13A is a full view illustrating an example of needlework for the second coupling portion of the golf cap having the ball marker according to the exemplary embodiment of the present invention.
Figure 13B:
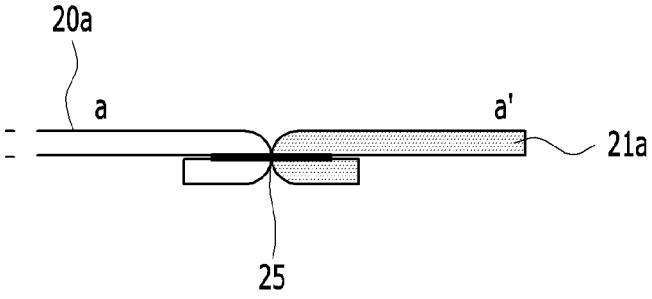
FIG. 13B is a cross sectional view of the example shown in FIG. 13A.

In addition, as illustrated in FIG. 13, regarding the second coupling portion 21, a part of an outer fabric 20*a* of the cap 20 is removed, a female member fabric panel or male member fabric panel 21*a* having the female member or male member having the same height is disposed so as to face each other, and an end of the outer fabric 20*a* of the cap 20 and an end of the female member fabric panel or male member fabric panel 21*a* are folded inward, sewed, and then connected and finished using a sewing thread 25.

The specific exemplary embodiment has been described above for helping the understanding of the golf cap having the ball marker according to the present invention, but it should be understood that the technical spirit of the present invention is not limited by the specific exemplary embodiment, and possible alterations or modifications, which may be sufficiently made from the claims and the detailed description by those skilled in the technical field to which the present invention pertains, fall within the scope of the present invention.

DESCRIPTION OF SYMBOLS

| | | | |
|---|---|---|---|
| 10: | Ball marker | 11: | First coupling portion |
| 11a: | Female member or male member | 12: | Main body |
| 12a: | Decorative surface | 12b: | Wing end |
| 13: | Adhesive layer | 14: | Rivet portion |
| 20: | Cap | 20a: | Outer fabric |

-continued

| | | | |
|---|---|---|---|
| 21: | Second coupling portion | 21a: | Female member or male member |
| 22: | Visor portion | 23: | Crown portion |
| 24: | Needlework portion | 25: | Sewing thread |

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A golf cap comprising:

a crown:

a visor; and a ball marker, wherein the ball marker comprises a main body, a first coupling portion, an adhesion portion, and an auxiliary coupling portion, the visor comprises an outer fabric covering and directly contacting a first part of an upper surface of the visor, a second coupling portion disposed on and directly contacting a second part of the upper surface of the visor from which the outer fabric is removed, and a connection portion between the outer fabric and the second coupling portion, wherein the upper surface of the visor faces a first direction in which the crown protrudes, the main body is made of at least one of stone, wood, and synthetic resin materials, the first coupling portion is made of a synthetic resin material, the first coupling portion having one surface formed with a plurality of male members or female members which have a predetermined shape, the adhesion portion is formed in a form of a double-sided adhesive sheet, the second coupling portion which corresponds to the first coupling portion has a plurality of female members when the one surface of the first coupling portion has a plurality of male members, or has a plurality of male members when the one surface of the first coupling portion has a plurality of female members, so that the ball marker is attachable to and detachable from the second coupling portion, the auxiliary coupling portion made of natural rubber, polyurethane, or PVC is provided to surround an edge of the main body, the auxiliary coupling portion having a bottom portion, a wall portion formed along an edge of the bottom portion, the wall portion having a constant height, and an opening surrounded by the wall portion, the main body tightly fits into the opening of the auxiliary coupling portion and is separable from the opening of the auxiliary coupling portion in use, and a height of the main body is greater than the height of the wall portion, and the connection portion between the second coupling portion and the outer fabric covering of the visor adjacent to the second coupling portion is covered by a needlework portion.

2. The golf cap of claim 1, wherein:

the auxiliary coupling portion is coupled to the main body of the ball marker by the adhesion portion.

3. A golf cap comprising:

a crown;

a visor; and a ball marker, wherein the ball marker comprises a main body, a first coupling portion, an adhesion portion, and an auxiliary coupling portion, the visor comprises an outer fabric and a second coupling portion forming an upper surface of the visor, the main body is made of at least one of stone, wood, and synthetic resin materials, the first coupling portion is made of a synthetic resin material, the first coupling portion having one surface formed with a plurality of male members or female members which have a predetermined shape, the adhesion portion is formed in a form of a double-sided adhesive sheet, the second coupling portion which corresponds to the first coupling portion, and has a plurality of female members when the one surface of the first coupling portion has a plurality of male members, or has a plurality of male members when the one surface of the first coupling portion has a plurality of female members, so that the ball marker is attachable to and detachable from the second coupling portion, the auxiliary coupling portion made of natural rubber, polyurethane, or PVC is provided to surround an edge of the main body, the auxiliary coupling portion having a bottom portion, a wall portion formed along an edge of the bottom portion, the wall portion having a constant height, and an opening surrounded by the wall portion, the main body tightly fits into the opening of the auxiliary coupling portion and is separable from the opening of the auxiliary coupling portion in use, and a height of the main body is greater than the height of the wall portion, and an end of the second coupling portion and an end of the outer fabric of the visor adjacent to the second coupling portion are folded inwards and sewn together with a sewing thread wherein the upper surface of the visor faces a first direction in which the crown protrudes.

* * * * *